US006176681B1

(12) United States Patent
Strömberg et al.

(10) Patent No.: US 6,176,681 B1
(45) Date of Patent: Jan. 23, 2001

(54) ROTOR BLADE WITH IMPROVED ATTACHMENT ON A HUB OF A FAN

(75) Inventors: Karl-Otto Strömberg, Halmstad; Ingemar Johansson, Växjö ; Sören Gränfors, Rottne, all of (SE)

(73) Assignee: ABB Fläkt AB (SE)

( * ) Notice: Under 35 U.S.C. 154(b), the term of this patent shall be extended for 0 days.

(21) Appl. No.: 09/297,581

(22) PCT Filed: Oct. 29, 1997

(86) PCT No.: PCT/SE97/01804

§ 371 Date: Jun. 7, 1999

§ 102(e) Date: Jun. 7, 1999

(87) PCT Pub. No.: WO98/21481

PCT Pub. Date: May 22, 1998

(30) Foreign Application Priority Data

Nov. 8, 1996 (SE) ..... 9604118

(51) Int. Cl.[7] ..... F04D 29/38

(52) U.S. Cl. ..... 416/226; 416/230; 416/239; 416/248

(58) Field of Search ..... 416/204 R, 205, 416/207, 209, 229 R, 229 A, 230, 241 A, 226, 239, 248

(56) References Cited

U.S. PATENT DOCUMENTS

| | | | | |
|---|---|---|---|---|
| 3,554,664 | * | 1/1971 | Cheeseman et al. | 416/230 |
| 3,734,642 | * | 5/1973 | Dixon | 416/248 |
| 4,877,376 | | 10/1989 | Sikorski et al. . | |
| 4,884,948 | * | 12/1989 | Sikorski | 416/248 |
| 4,966,527 | | 10/1990 | Merz . | |

* cited by examiner

*Primary Examiner*—Christopher Verdier
(74) *Attorney, Agent, or Firm*—Burns Doane Swecker & Mathis L.L.P.

(57) ABSTRACT

A rotor blade attached on a hub of a fan includes a blade-part, produced essentially of a composite material of fiber reinforced plastic, and an integrated foot having at least one body for attachment of the rotor blade on the hub of the fan, and at least one reinforcement which is essentially rigid in its longitudinal direction. The reinforcement is fastened to the body and extends at least along one of the sides of the blade. The body is arranged to withstand a state of strain, acting in several axially different directions. The body also extends perpendicular to the sides of the blade, and through the foot to both sides of the blade-part, so as to form a counterweight against a tendency of the blade to turn during operation.

20 Claims, 3 Drawing Sheets

ROTOR BLADE WITH IMPROVED ATTACHMENT ON A HUB OF A FAN

TECHNICAL FIELD

The present invention relates to a rotor blade to be attached on a hub of a fan or the like, comprising a blade-part, produced essentially of a composite material of fibre reinforced plastic, and an integrated foot, having at least one body for attachment of the rotor blade on the hub of the fan, and at least one reinforcement means which is essentially rigid in its longitudinal direction the reinforcement means, being fastened to the body and extending at least along one of the sides of the blade-part.

BACKGROUND OF THE INVENTION

There is today a need of producing rotor blades of a material, which may resist an aggressive environment, for instance, in the chemical process industry, and which are relatively light, resulting in that the fan, on which the rotor blades are mounted, may be operated at higher speed and that in certain cases, the rotor blades may also be made smaller and thus less expensive. Attempts have therefore been made to produce rotor blades of composite material, such as fibre reinforced plastic.

Through U.S. Pat. No. 4,877,376 a rotor blade of fibre reinforced plastic is previously known, which has relatively low weight and may accordingly be operated at high speed. However, the fastening of the rotor blade is complicated, partly due to a bolt joint having bolts extending through a pressure flange, abutting against the plastic material, to a hub or an attachment device, and partly due to a shank, which extends into the attachment device and co-operates with means to provide a pre-stress of the rotor blade. In an aggressive environment such fastening is unsatisfactory, even if the material in the rotor blade is chemically resistant, the area around the pressure flange will be both chemically and mechanically affected. Thus, it has been shown that rotor blades, having fastening means of this kind, are subjected to great stress, during high speed, and thus tend to be destroyed by propagating cracks, arising in the area of the bolt joint.

Through U.S. Pat. No. 4,966,527 a rotor blade of fibre reinforced plastic is also previously known, which has relatively low weight and may accordingly be operated at high speed. However, the fastening of the rotor blade is complicated, with fibres forming loops around several mounting elements near the blade root, which elements extend substantially parallel to the sides of the blade.

SUMMARY OF THE INVENTION

An object of the present invention is to provide a simple and durable fastening of a rotor blade made of composite material, which also resists an aggressive environment. An additional object is to improve the operation conditions of the rotor blade.

These objects are achieved according to the invention with a rotor blade, which is characterised in that said body is arranged to withstand a state of strain, acting in several axially different directions, and that said body extends, mainly perpendicular to the sides of the blade, through the foot to both sides of the blade-part, and comprising fastening means located on each side of the blade-part.

In a preferred embodiment, the foot of the rotor blade comprises at least two bodies, preferably made of metal, such as steel or similar, which effectively may withstand a state of strain, acting in several axially different directions. The two bodies extend perpendicular through the foot to both sides of the blade and suitably each body consists of a beam, having a rounded lower edge. The two bodies may also be integrated with each other so as to from an H-shaped girder construction. Naturally, it is possible to use a body shaped like a plate, provided with recesses for the reinforcement means, or use only one beam, which by way of example is arranged obliquely in relation to the blade.

The reinforcement means suitably comprise an amount of orientated fibres and includes in a preferred embodiment, at least a bundle carbon fibre, which during manufacturing of each rotor blade in a mould, is placed around the body and lead out over the sides of the blade. Naturally, the reinforcement means may also be fastened to the body, for instance, by leading a bundle carbon fibre through a hole in the body, whereas it is fastened with a knot or similar, fastening having a larger diameter than the hole.

The composition of fibres and plastic in the composite material of the foot of the rotor blade is preferably selected such that the composite material has an elongation by temperature adapted to the body. The composite material is suitable made of glass-fibre reinforced epoxy resin.

BRIEF DESCRIPTION OF THE DRAWINGS

The invention will now be described closer with reference to the attached drawings, in which.

DETAILED DESCRIPTION OF THE INVENTION

Figure 1:
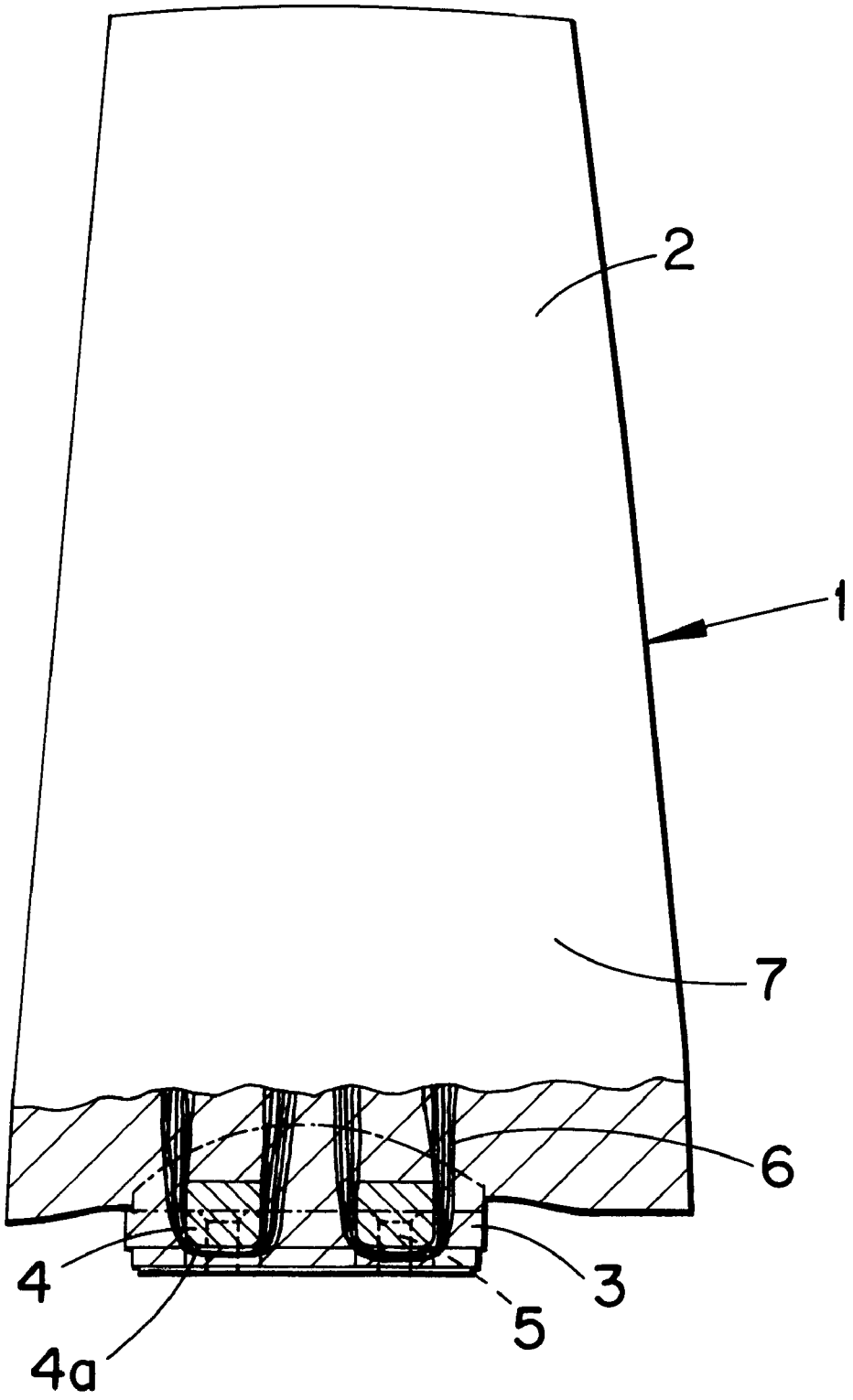
FIG. 1 shows a partially cross-section, front view of a rotor blade according to the present invention.
Figure 2:
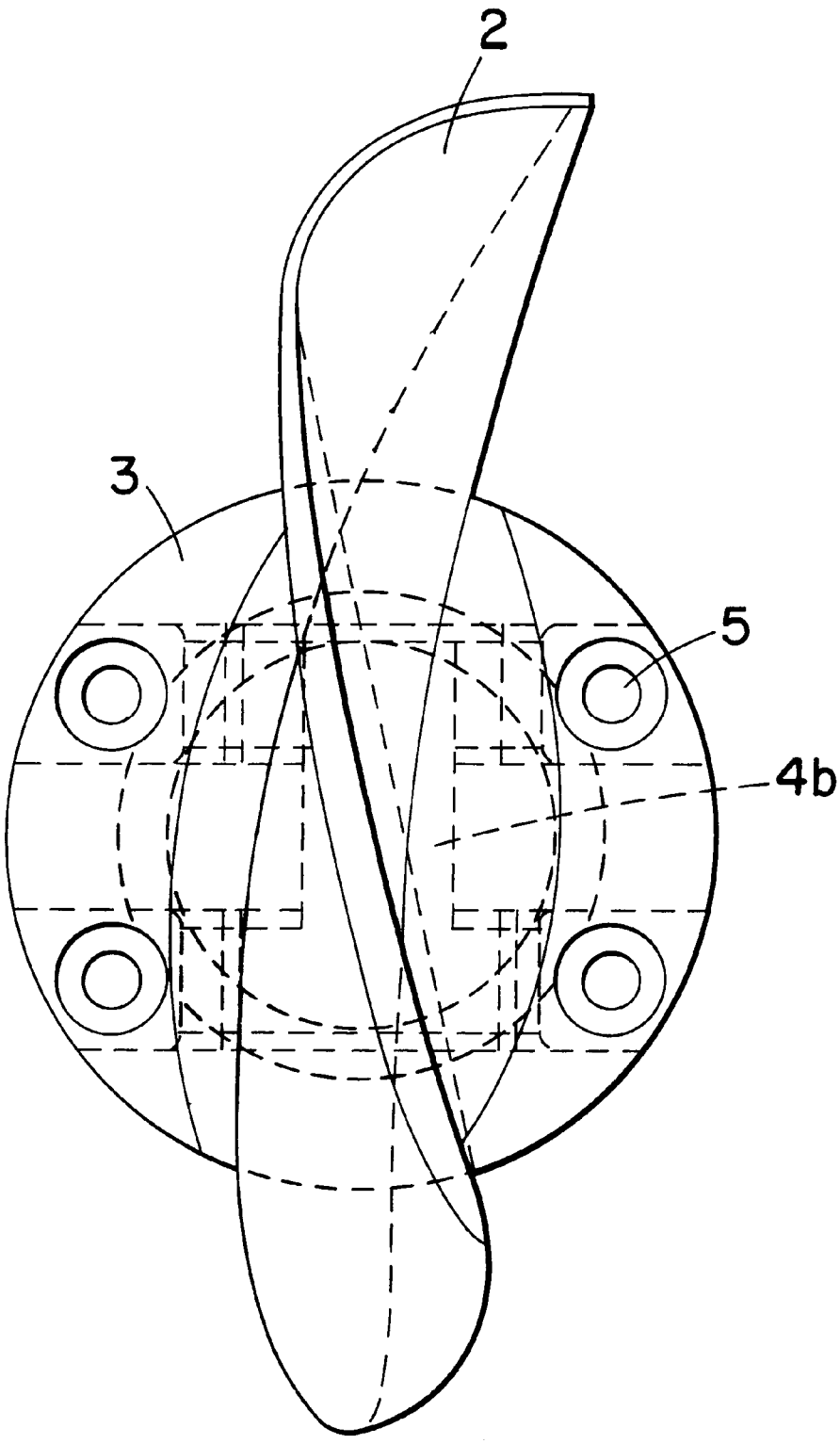
FIG. 2 shows a view from above of the rotor blade.

The drawings illustrate a rotor blade 1 for attachment on a hub of a fan (not shown) or the like. The rotor blade 1 comprises a blade-part 2 and an integrated foot 3. The foot 3 of the rotor blade comprise two bodies 4, with fastening means 5. The two bodies 4 are preferably made of metal, such as steel or the like, which may withstand a state of strain, acting in several axially different directions. The two bodies 4 extend perpendicular in relation to the sides 7 of the blade, and through the foot 3 to both sides of the blade-part 2. An amount of reinforcement means 6 extends at least partly around the two bodies 4 and along the sides 7 of the blade. The fastening means 5 may suitably include holes through the two bodies 4, which are intended to co-operate with bolts (not shown) screwed into the hub of a fan or into an attaching means arranged thereto.

The rotor blade 1 is made of a composite material of fibre reinforced plastic. In a preferred embodiment the composite material is a reinforced glass-fibre in a matrix of epoxy resin, which according to the invention are reinforced with an amount of reinforcement means 6 of several equally orientated fibres. Preferably, the fibres are long and continuous, and may as an example be composed of carbon fibre, but also other fibres, for instance, fibres of aramide or similar may be used as reinforcement means. In the same way, polymer other than an then epoxy resin may be used as the matrix.

Figure 4:
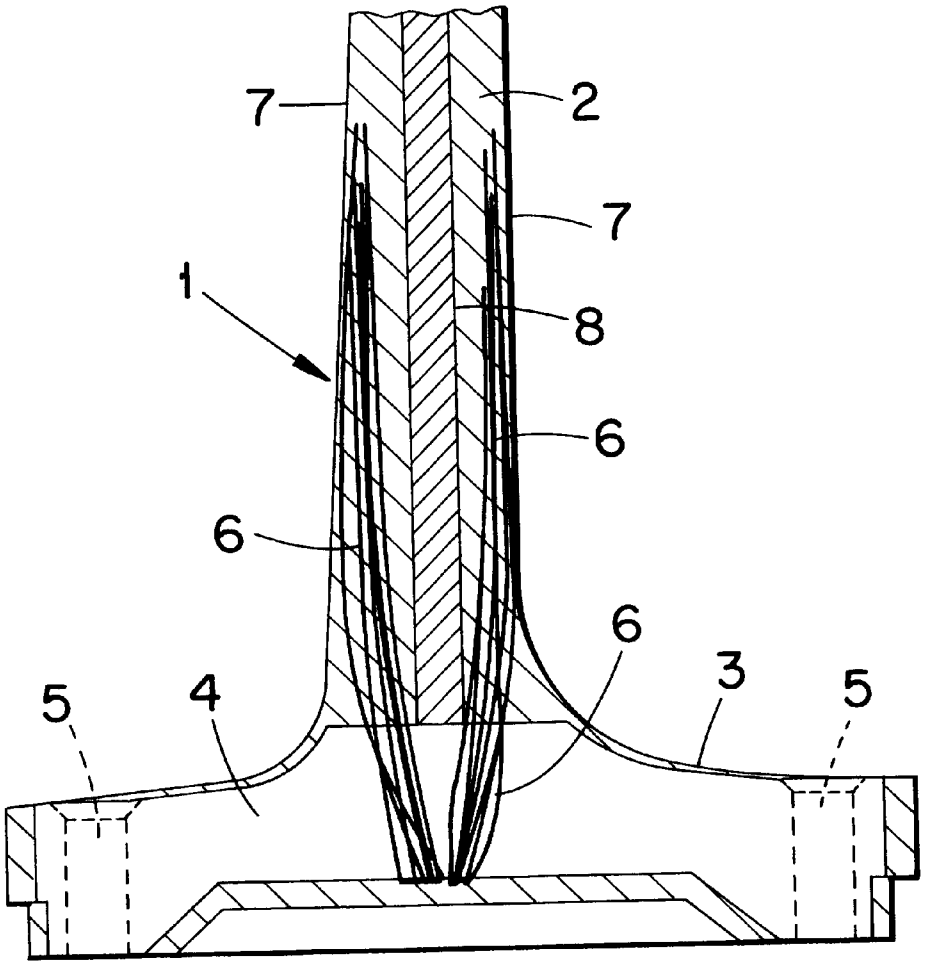
FIG. 4 shows a cross-section of an area around the foot of the rotor blade, in larger scale.
Figure 3:
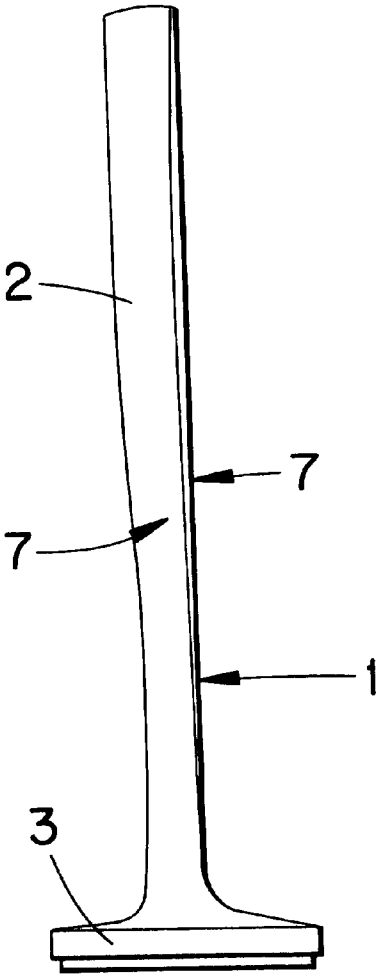
FIG. 3 shows a side-view of the rotor blade.

During production of the rotor blade 1 several layers of orientated glass-fibres are placed on each side of a mould, then the bodies 4 are arranged in one end of the mould, a bundle of reinforcement means 6, such as carbon fibre, for example, being placed around each body 4 and being lead along a plastic core 8 (FIG. 4), which is arranged between the layers of glass-fibre. Finally epoxy resin will be added.

Thus, the completed rotor blade 1 comprises a blade-part 2, made of a composite material, and more particulary, a glass-fibre reinforced epoxy resin, provided with a core 8 of plastic and an integrated foot 3, which likewise is made of composite material and at least one body 4, and several reinforcement means 6 of carbon fibre.

Thus, the foot 3 of the rotor blade includes the body 4, the reinforcement means 6 and the part of the composite material located around the body 4. Said body 4 extends, mainly perpendicular to the sides 7 of the blade, and through the foot 3, to both sides of the blade-part 2. By this, construction the body 4 forms a counterweight acting against the tendency of the blade-part 2 to turn around its own axle during operation. The body 4 is preferably made of metal, such as steel or similar, which may withstand a state of strain, acting in several axially different directions and has fastening means 5 on each side of the blade-part 2, which, in the example shown, are shaped as bolt-holes for fastening a bolt. The number of bolt-holes may vary from one to several bolt-holes on each side of the blade-part 2. As said above, the rotor blade 1 is fastened to a hub by means of the fastening bolts, which are inserted in the holes of the body 4 and screwed into the hub or into an attachment means arranged thereto. Even if the composite material essentially surrounds the body 4, it is advantageous that the fastening bolts solely extend through the body 4 and that in the area of the bolts there does not exist any essential amount of composite material.

The rotor blade 1, described above, is light compared to earlier used rotor blades made of metal, and it has proved to withstand high speed without bursting of the foot at the area of the bolt-joint. The forces acting on the rotor blade 1 are transmitted via the reinforcement means 6, such as carbon fibre, which is essentially stiff in its longitudinal direction, to the body 4, which may withstand a state of strain, acting in several axially different directions, and further, via the fastening bolts to the hub. An important part of the invention is that the reinforcement means 6 is fastened to the body 4, either by extending around the body 4 or being attached to the body 4 in a suitable manner. It is also important that the reinforcement means 6 extends over a part of the length of the rotor blades.

To avoid undesired stress of the reinforcement means, the body 4 is shaped as a beam, having rounded lower edges 4*a*. It is possible to use only one beam, even if the figures show use of two beams. It is also possible that the two bodies are integrated with each other and thus form an H-shaped girder construction 4*b* or that the body is shaped like a plate, provided with recesses for fastening of the reinforcement means.

The composition of fibres and plastic in the composite material of the foot 3 of the rotor blades is selected such that the composite material has an elongation dependent of the temperature, which is adapted to the body 4, in such way that the effect of the bodies expansion during different temperature conditions will be reduced as much as possible, i.e. the composite material will follow the body 4 in its movement dependent of the temperature.

What is claimed is:

1. Rotor blade to be attached on a hub of a fan comprising:

a blade-part produced essentially of a composite material of fibre reinforced plastic, and an integrated foot having at least one body for attachment of the rotor blade on the hub of the fan and at least one reinforcement means which is essentially rigid in its longitudinal direction, said at least one reinforcement means being fastened to the body and extending at least along one of the sides of the blade, wherein said at least one body is arranged to withstand a state of strain acting in several axially different directions, wherein said at least one body extends perpendicular to the sides of the blade and through the foot to both sides of the blade-part so as to form a counterweight against a tendency of the blade to turn during operation, and wherein said at least one body includes fastening means located on each side of the blade-part.

2. Rotor blade according to claim 1, wherein a composite material essentially surrounds the at least one body.

3. Rotor blade according to claim 1, wherein the reinforcement means includes a number of equally orientated fibres.

4. Rotor blade according to claim 3, wherein the reinforcement means extends at least partly around the at least one body.

5. Rotor blade according to claim 3, wherein the reinforcement means is attached to the at least one body.

6. Rotor blade according Lo claim 1, wherein said at least one body comprises two beam-shaped bodies which are designed with a rounded lower edge.

7. Rotor blade according to claim 6, wherein the two bodies are integrated with each other so as to form an H-shaped girder construction.

8. Rotor blade according to claim 1, wherein the at least one body is shaped like a plate, provided with recesses for fastening of the reinforcement means.

9. Rotor blade according to claim 1, wherein the composite material includes a glass-fibre reinforced epoxy resin, and the reinforcement means include carbon fibre.

10. Rotor blade according to claim 1, wherein the at least one body is made of metal.

11. Rotor blade according to claim 2, wherein the reinforcement means includes a number of equally oriented fibres.

12. Rotor blade according to claim 11, wherein the reinforcement means extends at least partly around the at least one body.

13. Rotor blade according to claim 11, wherein the reinforcement means are attached to the at least one body.

14. Rotor blade according to claim 2, wherein said at least one body comprises two beam-shaped bodies which are designed with a rounded lower edge.

15. Rotor blade according to claim 3, wherein said at least one body comprises two beam-shaped bodies which are designed with a rounded lower edge.

16. Rotor blade according to claim 2, wherein the at least one body is shaped like a plate, provided with recesses for fastening of the reinforcement means.

17. Rotor blade according to claim 3, wherein the at least one body is shaped like a plate, provided with recesses for fastening of the reinforcement means.

18. Rotor blade according to claim 2, wherein the composite material includes a glass-fibre reinforced epoxy resin, and the reinforcement means include carbon fibre.

19. Rotor blade according to claim 3, wherein the composite material includes a glass-fibre reinforced epoxy resin, and the reinforcement means include carbon fibre.

20. Rotor blade according to claim 2, wherein the at least one body is made of metal.

* * * * *